US006612273B1

(12) United States Patent
Schumacher

(10) Patent No.: US 6,612,273 B1
(45) Date of Patent: Sep. 2, 2003

(54) DUAL-PISTON COMPRESSION CHAMBER FOR TWO-CYCLE ENGINES

(76) Inventor: Paul Schumacher, 90 Mayo Rd., Colchester, VT (US) 05446

( * ) Notice: Subject to any disclaimer, the term of this patent is extended or adjusted under 35 U.S.C. 154(b) by 0 days.

(21) Appl. No.: 10/047,570

(22) Filed: Jan. 15, 2002

(51) Int. Cl.[7] ..... F02B 25/08
(52) U.S. Cl. ..... 123/65 VB
(58) Field of Search ..... 123/58.3, 65 VB, 123/59.7, 61 R, 51 B, 50 B, 51 BA, 65 A, 65 P, 65 V, 65 VC, 65 VD, 73 V, 74 D, 73 AE, 73 AV

(56) References Cited

U.S. PATENT DOCUMENTS

| | | | | |
|---|---|---|---|---|
| 464,223 | A | * 12/1891 | Fasoldt | 417/259 |
| 780,812 | A | 1/1905 | Radovanovic | |
| 874,634 | A | 12/1907 | St. German | |
| 898,768 | A | 9/1908 | Murphy | |
| 912,751 | A | 2/1909 | Steely | |
| 929,769 | A | 8/1909 | Kulage | |
| 931,319 | A | 8/1909 | Krotz | |
| 936,972 | A | * 10/1909 | Wright | 123/61 R |
| 1,183,904 | A | 5/1916 | Palmer | |
| 2,065,046 | A | * 12/1936 | Bronander | 123/51 B |
| 2,714,875 | A | 8/1955 | Carroll | |
| 4,455,974 | A | 6/1984 | Shapiro et al. | |
| 4,964,379 | A | 10/1990 | August | |
| 5,626,106 | A | 5/1997 | Erickson et al. | |
| 5,809,947 | A | 9/1998 | Thompson | |
| 5,884,590 | A | * 3/1999 | Minculescu | 123/71 R |

* cited by examiner

*Primary Examiner*—Henry C. Yuen
*Assistant Examiner*—Hyder Ali
(74) *Attorney, Agent, or Firm*—Michael I. Kroll

(57) ABSTRACT

A dual piston compression chamber for two-cycle engines wherein a primary piston and an exhaust/intake piston travel at different rates within a compression chamber to draw a charge through one-way intake ports and subsequently through one-way passages extending through the secondary piston so as to trap said charge between the secondary piston and the ascending primary piston with the area therebetween defining the compression chamber where the charge is adiabatically compressed and ignited.

14 Claims, 10 Drawing Sheets

COMPRESSION STROKE

COMPRESSION STROKE

END OF COMPRESSION STROKE/BEGINNING OF POWER STROKE

DUAL-PISTON COMPRESSION CHAMBER FOR TWO-CYCLE ENGINES

BACKGROUND OF THE INVENTION

1. Field of the Invention

The present invention relates generally to two-cycle engines and, more specifically, to a dual piston compression chamber for two-cycle engines having a primary piston and an exhaust/intake piston, said exhaust/intake piston having a plurality of one-way valve controlled passages extending therethrough to provide controlled communication between the intake ports and the compression area located between the two pistons. The present invention may also be adapted for application with spark ignition engines.

2. Description of the Prior Art

There are other two cycle engines. Typical of these is U.S. Pat. No. 780,812 issued to Radovanovic on Jan. 24, 1905.

Another patent was issued to Germaine on Dec. 24, 1907 as U.S. Pat. No. 874,634. Yet another U.S. Pat. No. 898,768 was issued to Murphy on Sept. 15, 1908 and still yet another was issued on Feb. 16 1909 to Steely as U.S. Pat. No. 912,751.

Another patent was issued to Kulage on Aug. 3, 1909 as U.S. Pat. No. 929,769. Yet another U.S. Pat. No. 931,319 was issued to Krotz on Aug. 17, 1909 and still yet another was issued on May 23, 1916 to Palmer as U.S. Pat. No. 1,183,904. A patent was issued to Carroll on Aug. 9, 1955 as U.S. Pat. No. 2,714,875 and Shapiro was issued U.S. Pat. No. 4,455,974 on Jun. 26, 1984. U.S. Pat. No. 4,964,379 was issued on Oct. 23, 1990 to August and on May 6, 1997 Erickson et al. was issued U.S. Pat. No. 5,626,106. Thompson was issued U.S. Pat. No. 5,809,947 on Sep. 22, 1998.

U.S. Pat. No. 780,812

Inventor: Andreas Radovanovic

Issued: Jan. 24, 1905

In combination, a cylinder having midway of its length internal peripheral exhaust-ports, a piston controlling said ports, a piston extension, a mixing-chamber therein having ports adapted to place the cylinder in communication with said chamber, the latter provided with air and gas admission ports and means to supply air and gas to said ports respectively, said supply and the admission of the mixture to the cylinder controlled by the movements of the piston extension, for the purpose set forth.

U.S. Pat. No. 874,634

Inventor: William A. St. Germain

Issued: Dec. 24, 1907

In an internal combustion engine, a pair of cylinders arranged head to head and in alignment with each other, pistons in said cylinders, a piston rod extending through the head cylinder and to which both pistons are secured, a crank shaft connected to one of the pistons, upper and lower compression chambers connected to the open ends of the cylinders, inlet ports leading from the compression chambers through the walls of the cylinders, exhaust ports leading from the cylinders and arranged to be uncovered by the pistons at the outer limits of their strokes, all the said ports being controlled by the pistons, a valve chamber intermediate the compression chambers and having a fluid inlet, and valves arranged in said valve chamber and controlling communication between the latter and the compression chambers.

U.S. Pat. No. 898,768

Inventor: George F. Murphy

Issued: Sept. 15, 1908

In a two cycle engine, the combination of a cylinder and a piston, the space on one side of the piston being for combustion and having a clearance space so proportioned to the effective piston displacement at this end of the cylinder as to produce a compression and resulting temperature high enough to ignite the fuel to be consumed, the space on the other side of the piston being for initial compression, a valve controlled passage between the two spaces and cooperating with each other U.S. Pat. No. 4,455,974

Inventor: Wilbur Shapiro et al.

Issued: Jun. 26, 1984

A gas bearing supported piston assembly (2) for an internal combustion engine including a piston body (14, 14') and a segmented piston ring (3) arranged to expand to compensate for wear. A piston supporting gas layer (27) is formed between the cylinder walls (8) and the exterior surface of each piston ring segment (32) by means of a plurality of restricted flow passages (40) formed in each segment (32) and extending between the inner and outer surfaces of the segment (32). In one embodiment, gas under pressure is supplied to the ring segments (32) through a single annular cavity (36) formed in piston body (14). In another embodiment, gas under pressure is supplied to the ring segments (32) through a plurality of corresponding holes (70) in piston body (14').

U.S. Pat. No. 4,964,379

Inventor: Paul August

Issued: Oct. 23, 1990

Two pistons in adjacently situated cylinders in a twin-piston two-stroke engine share a common combustion chamber. To ensure low exhaust gas emissions with low consumption, a lean mixture is burnt whereof the complete combustion is made possible by designing the combustion chamber so that circulation of the ignited mixture takes place and the mixture burns through rapidly. The twin-piston two-stroke engine may also be devised to run with a stratified charge, the centrally arranged partition in the twin cylinder providing excellent separation between the lean and rich mixture portions.

U.S. Pat. No. 5,626,106

Inventor: Frederick L. Erickson et al.

Issued: May 6, 1997

Design Improvements are disclosed which enhance the migrating combustion chamber engine's ability to achieve improved performance, obtain higher durability and cost less to manufacture. These include strip seals between the combustion chamber member and orbiting piston which are adapted to respond to the pressure of combustion to increase contact pressure and improve retention of the gases in the combustion chambers as well as improved porting located in at least one power block sidewall and cooperating with the migrating combustion chamber to convey hot combustion gasses from a combustion chamber to a corresponding secondary expansion chamber. The combustion chamber member may be formed of two reciprocable piston portions and a pair of separate alloy steel connecting bars coupling the piston portions together. The connecting bars made of a low thermal conductivity material to remain hot and aid in fuel evaporation. A one piece counterweight hub provides all required counterweights. It attaches to the crankshaft by a first clamp which clamps the counterweight hub onto the crankshaft, and second clamp which pulls an inside bore of the hub axially tight against an end of the crankshaft. Improvements in exhaust porting, ignition location, manifold and combustion chamber member designs as well as unique power block housing wear strips and crankshaft counterbalancing techniques are also disclosed.

U.S. Pat. No. 5,809,947

Inventor: Kevin R. Thompson

Issued: Sep. 22 1998

A valve is provided for a piston of a two stroke engine wherein the piston has a sidewall and top and bottom surfaces with the top surface having a first opening therein and a second opening extending between the top and bottom surfaces for receiving the valve, and wherein the piston has a plurality of pressure relief openings extending between the top and bottom surfaces. The valve comprises a valve plate positioned in the opening in the top surface overlaying the pressure relief openings with the valve plate having a central opening extending parallel to the sidewall. The valve plate is movable from a seated position covering the pressure relief openings to an unseated position exposing the pressure relief openings when pressure inside the piston exceeds a predetermined value. A retainer pin has an elongated body extending through the central opening in the valve plate, a head atop the retainer pin overlying the valve plate, and a hollow end portion flared radially outward against the bottom surface of the piston to limit upward movement of the retainer pin. The valve opens on the downstroke of the piston to relieve some of the crankcase pressure allowing the piston to descend with less resistance.

While these two cycle engines may be suitable for the purposes for which they were designed, they would not be as suitable for the purposes of the present invention, as hereinafter described.

SUMMARY OF THE PRESENT INVENTION

A primary object of the present invention is to provide a dual piston compression chamber for two cycle engines having a primary piston and an exhaust/intake piston that cooperate with one another and form a compression chamber therebetween.

Another object of the present invention is to provide a dual piston compression chamber for two cycle engines wherein the exhaust/intake piston has a plurality of passages extending the rethrough and one-way check valves residing therein to regulate the directional flow of fuel and air from the intake ports to the compression chamber.

Yet another object of the present invention is to provide a dual piston compression chamber for two cycle engines wherein the check valves could include but are not limited to reed valves or inertial valves.

Still yet another object of the present invention is to provide a dual piston compression chamber for two cycle engines that will enable a two cycle engine to perform with a similar efficiency and emissions as a four cycle engine while maintaining a low RPM, increased torque, and greater power for engine weight.

Yet another object of the present invention is to provide a dual piston compression chamber for two cycle engines that is inexpensive to manufacture and operate.

One more object of the present invention is to provide a dual piston compression chamber for two cycle engines that is simple to use.

Additional objects of the present invention will appear as the description proceeds.

The present invention overcomes the shortcomings of the prior art by providing a dual piston compression chamber with positive displacement for two cycle engines that will produce four cycle efficiency and emissions with reduced RPM and increased torque. The present invention could be particularly useful in aircraft engines due to the greater power for a given engine weight and fewer moving parts wherein the design allows for applications with a variety of fuels.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
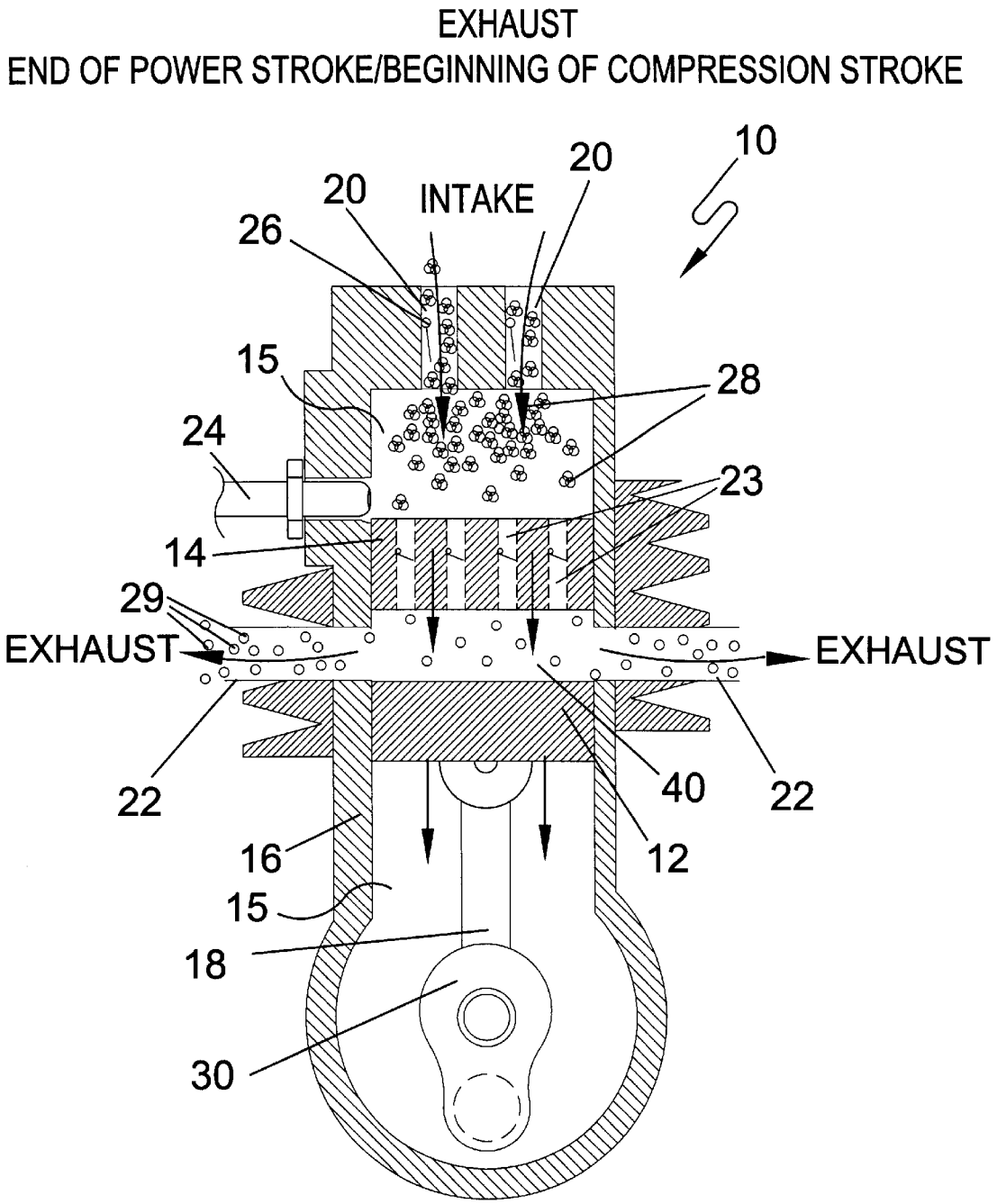
FIG. 1 is a diagram of the present invention at the beginning of the compression stroke.

Turning now descriptively to the drawings, in which similar reference character denote similar elements throughout the several views, the Figures illustrate the valveless revolving cylinder engine of the present invention. With regard to the reference numerals used, the following numbering is used throughput the various drawing figures.

10 dual piston compression chamber for two cycle engines
12 primary piston
14 intake/exhaust piston
15 cylinder
16 engine housing
18 connecting rod
20 intake port
22 exhaust port
23 piston port
24 fuel injector
25 atomized fuel
26 one-way check valve
28 air charge
29 burned gases
30 crankshaft assembly
32 cam wheel
34 intake/exhaust piston follower
36 spark plug
38 spark
40 compression chamber
44 burned gases
46 connecting rod
48 follower connecting rod
50 intake/exhaust piston follower track
52 fuel/air mixture
54 combustible media
56 synchronization regulation means

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Figure 2:
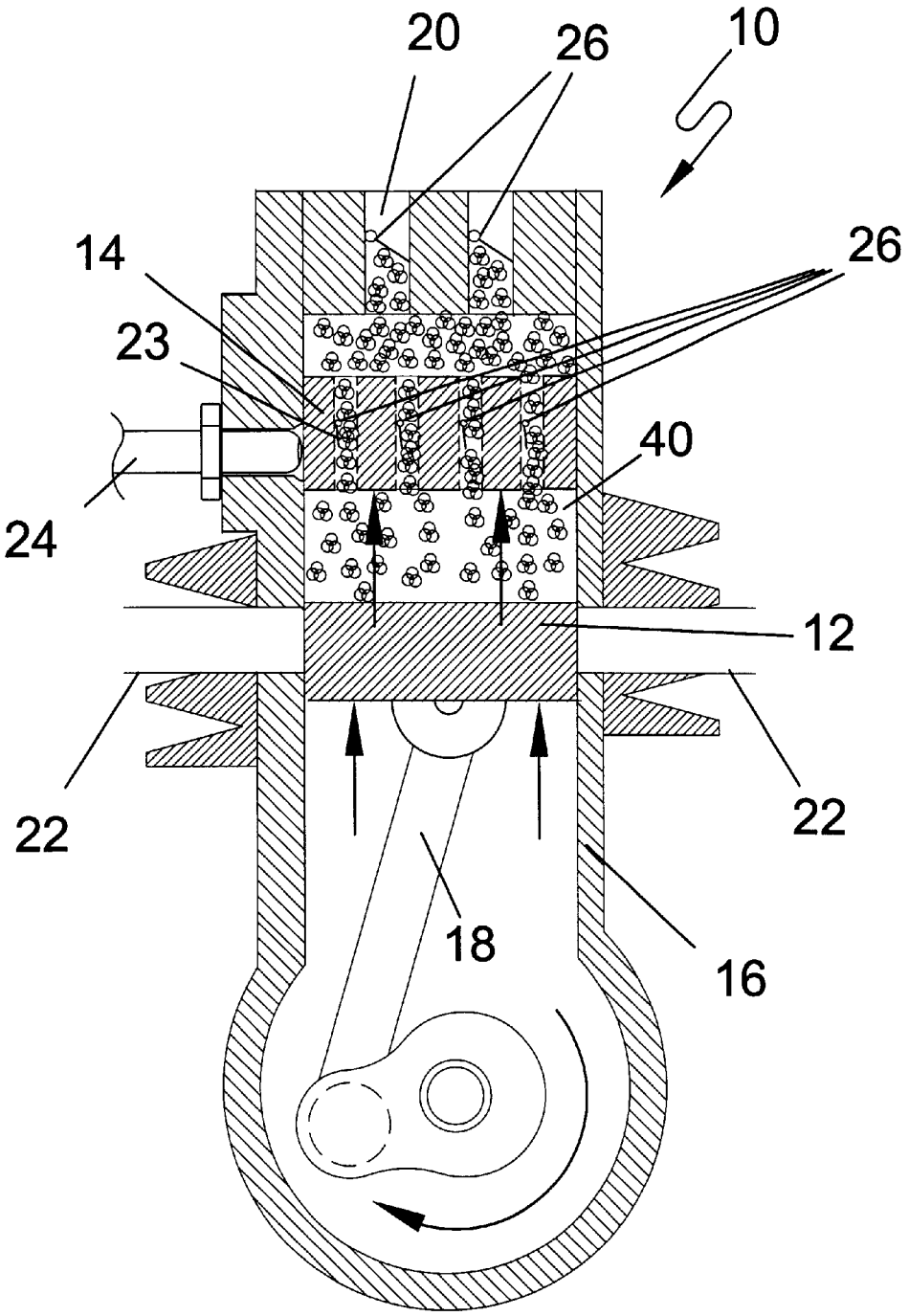
FIG. 2 is a diagram of the present invention in the middle of the compression stroke.
Figure 3:
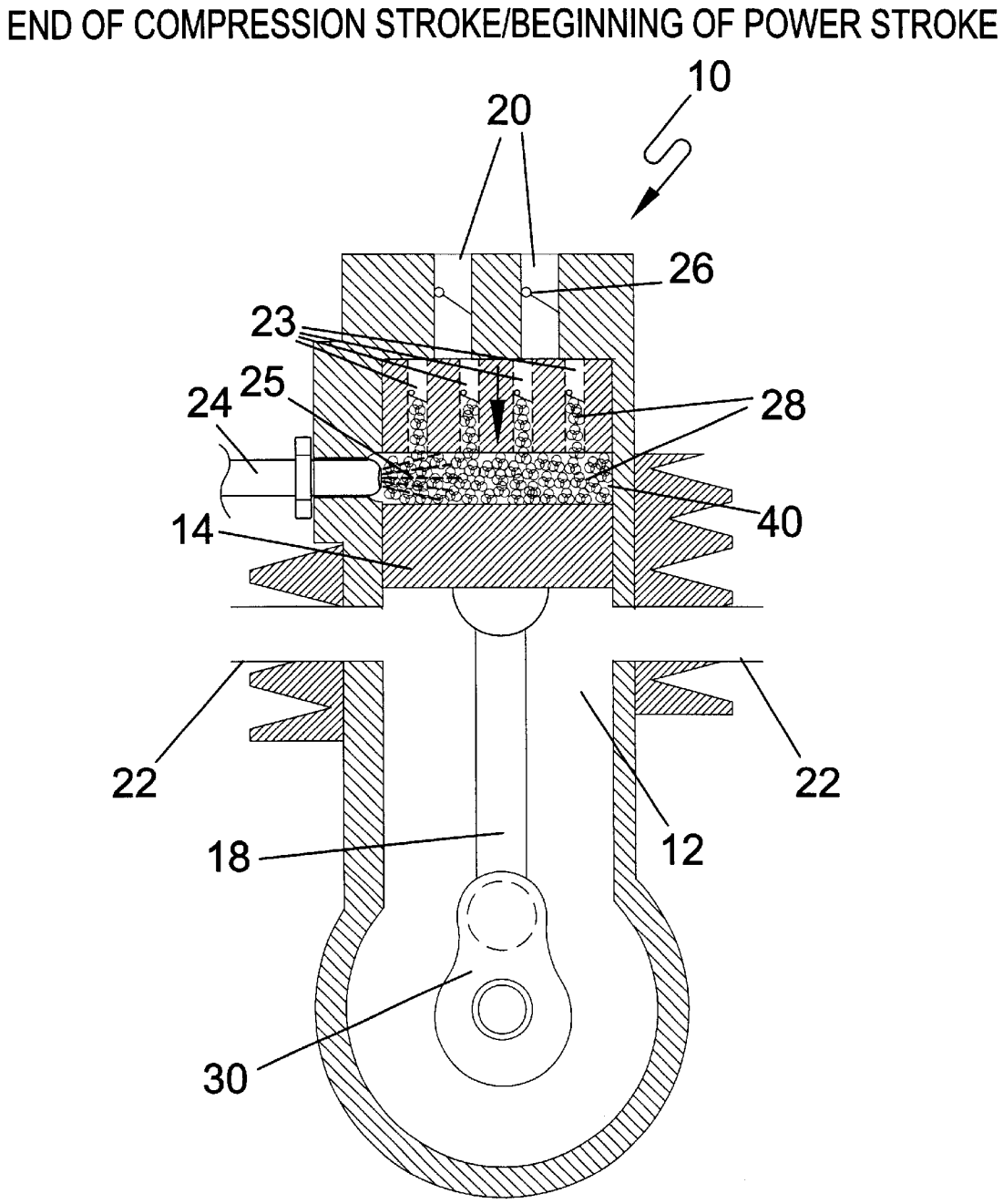
FIG. 3 is a diagram of the present invention during the end of the compression stroke/beginning of the power stroke.
Figure 4:
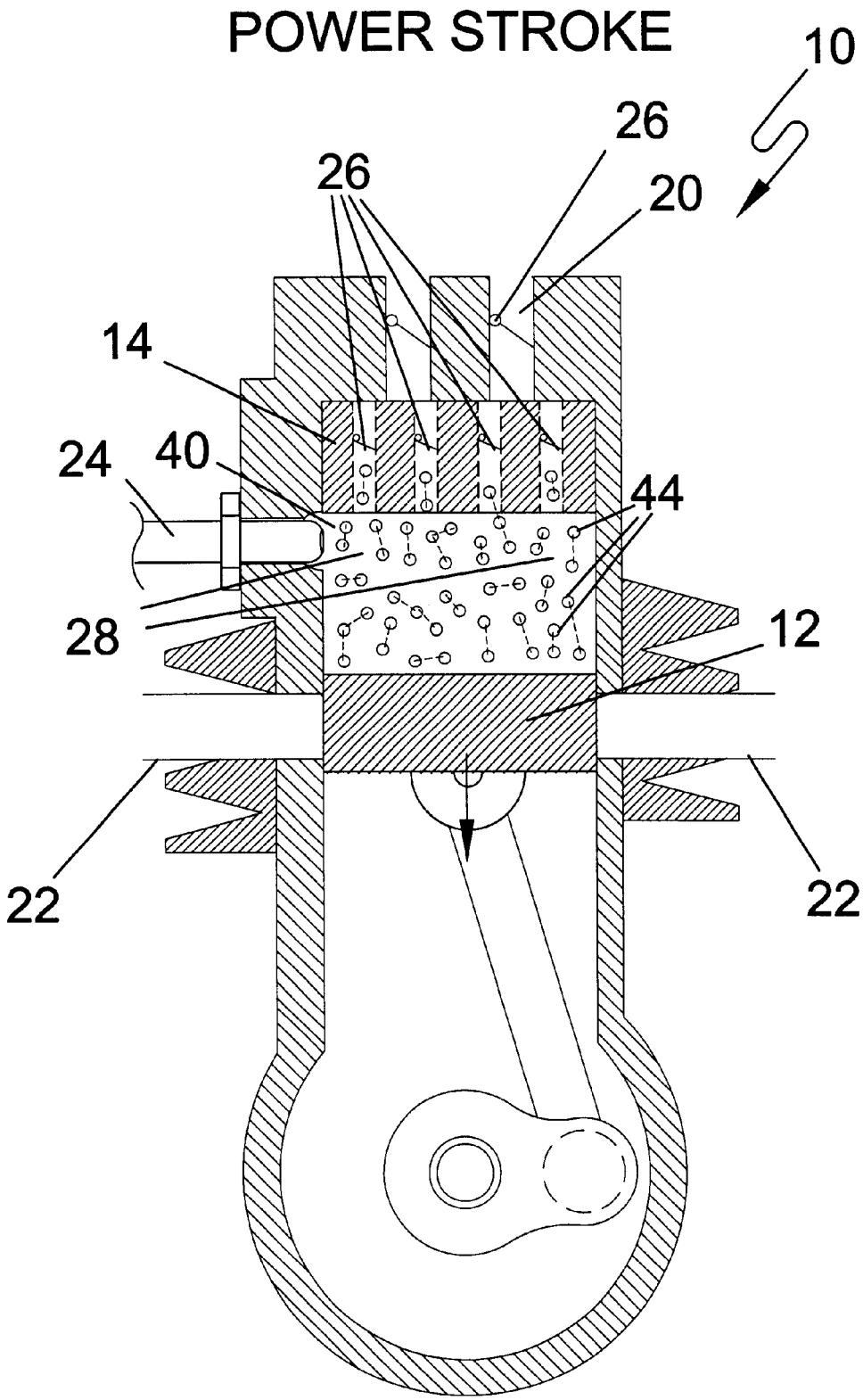
FIG. 4 is a diagram of the present invention during the middle of the power stroke.

FIGS. 1, 2, 3 and 4 are cross sectional front views of the present invention 10 as applied to a two-cycle compression ignition engine with FIGS. 1, 2 and 3 demonstrating stages of the compression stroke. FIG. 1 shows the end of the power stroke/beginning of the compression stroke. At the beginning of the compression stroke the primary piston 12 has fully descended and the exhaust ports 22 are uncovered thus allowing the descending intake/exhaust piston 14 to purge the burned gases 29; simultaneously, scavenging air 28 is entering the cylinder 15 above the intake/exhaust piston 14 through the intake ports 20 to provide a combustible media 54. One-way check valves 26 in the intake ports 20 permit a fresh air charge 28 to travel into the cylinder 15 while prohibiting it from exiting therethrough. Piston ports 23 extending through the intake/exhaust piston 14 also include one -way check valves to allow for the directional transfer of gases therethrough from the portion of the cylinder 15 above the intake/exhaust piston 14 to the area between the primary piston 12 and the intake/exhaust piston 14 which defines the compression chamber 40 while preventing the backflow of such gases. FIG. 2 depicts the present invention 10 in the middle of the compression stroke wherein the intake/exhaust piston 14 is advancing towards the top of the cylinder 15 where a fresh air charge 28 has been introduced through the intake ports 20 which are now sealed by the one-way valves 26 incorporated therein due to the back pressure resulting from the advancing intake/exhaust cylinder 14 thus channeling the charge 28 though the piston ports 20 and into the compression chamber 40 where it is contained due to the following primary piston 12 having sealed off the exhaust ports 22. The primary piston 12 will continue to compress the charge 28 therein for the remainder of the stroke. The end of the compression stroke/beginning of the power stroke is shown in FIG. 3 wherein the intake/exhaust piston 14 has reached its zenith and has channeled the charge 28 into the compression chamber 40 where it is compressed adiabatically to a high temperature with the advance of the primary piston 12. When near maximum compression has been achieved, just before dead center, a fuel injector 24 introduces a finely atomized fuel 25 into the heated air charge 28 in the compression chamber 40 initiating auto-ignition of the mixture and the subsequent power stroke which is illustrated in FIGS. 3, 4 and 1.

The introduction of fuel 25 into the compression chamber 40 as shown in FIG. 3 causes the combustion thereof and the expanding hot mixture acts upon the primary piston 12 and thrusts it downward as shown in FIG. 4 for the remainder of the power stroke. Referring back to FIG. 1 the intake/exhaust piston 12 soon follows and scavenges a fresh air charge 28 through the intake ports 20 and the continued descent of the primary piston 12 exposes the exhaust ports 22 through which burned gases 29 are expelled by the descending intake/exhaust piston 12.

Figure 5:
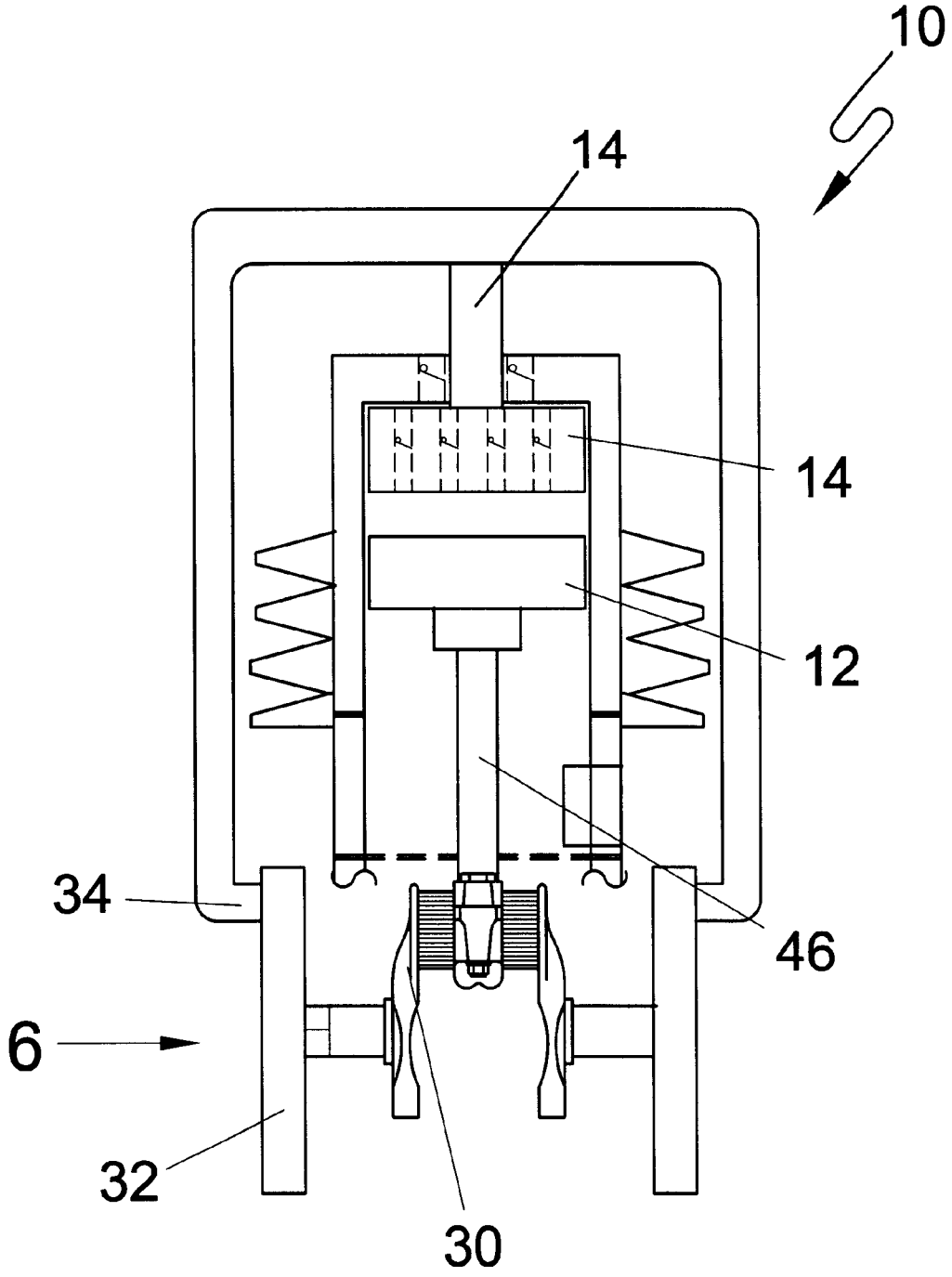
FIG. 5 is a front view of the present invention showing the mechanical drive arrangement.
Figure 6:
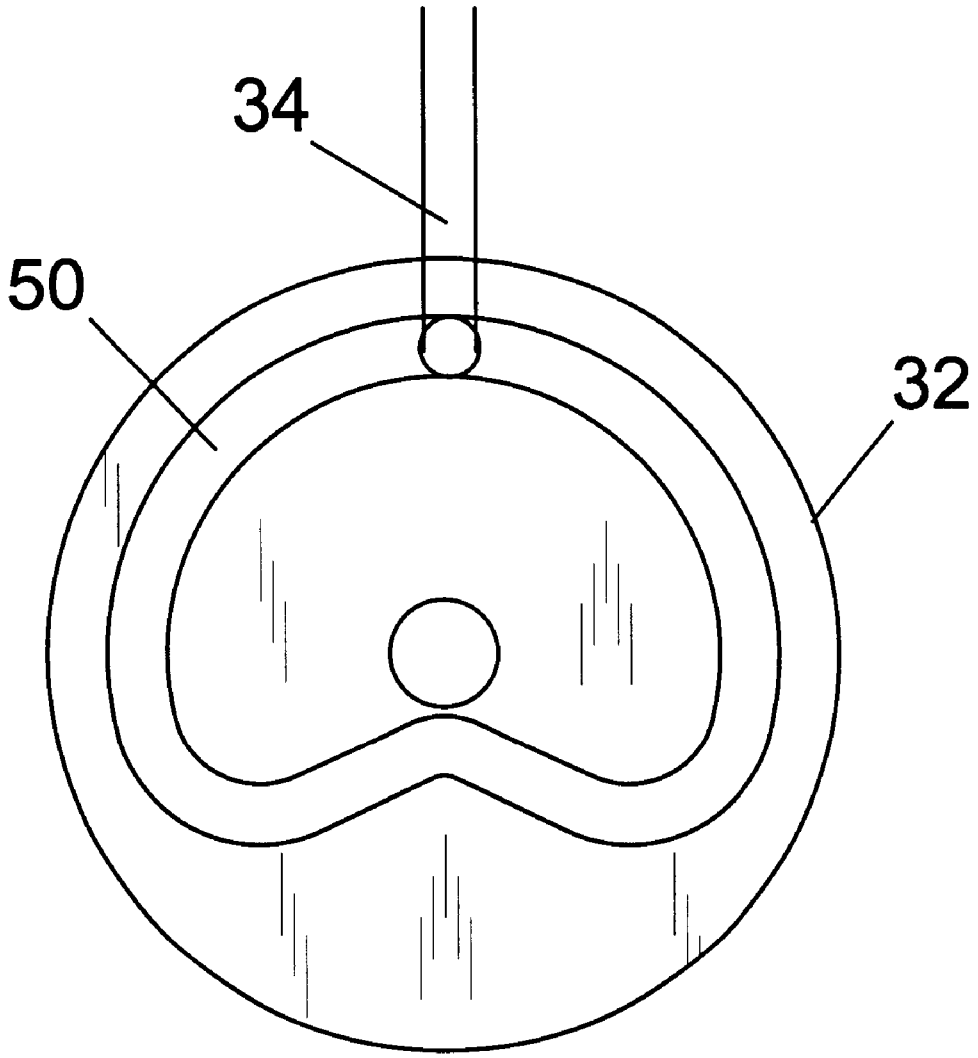
FIG. 6 is a side view of the cam wheel method taken from FIG. 4 as indicated.

FIGS. 5 and 6 show the preferred mechanical drive arrangement of the primary components that provide synchronization regulation means 56 of the primary piston 12 and the exhaust/intake piston 14 while allowing for the differences required in timing for the travel of the two pistons although any other suitable drive arrangement may be used that would accomplish the objectives of the present invention. FIG. 5 is a side view of the present invention showing the primary piston 12 driven by a substantially conventional crankshaft assembly 30 and connecting rod 46. A cam wheel 32 is connected on either side of the crankshaft assembly 30 and has an intake/exhaust piston follower track 50 as is shown in FIG. 6 in which intake/exhaust piston followers 34 are entrained. The intake/exhaust piston followers 34 are in communication with the intake/exhaust piston 14 via at least one follower connecting rod 48 thus providing the reciprocating action of the intake/exhaust piston 14 in response to the axial rotation of the cam wheels 32 thereby enabling the crankshaft assembly 30 to regulate the travel of both the primary piston 12 and the intake/exhaust piston 14 even though each travels at its own rate and distance to provide synchronicity thereof for the alignment of the various pistons and ports through the operating cycle.

Figure 7:
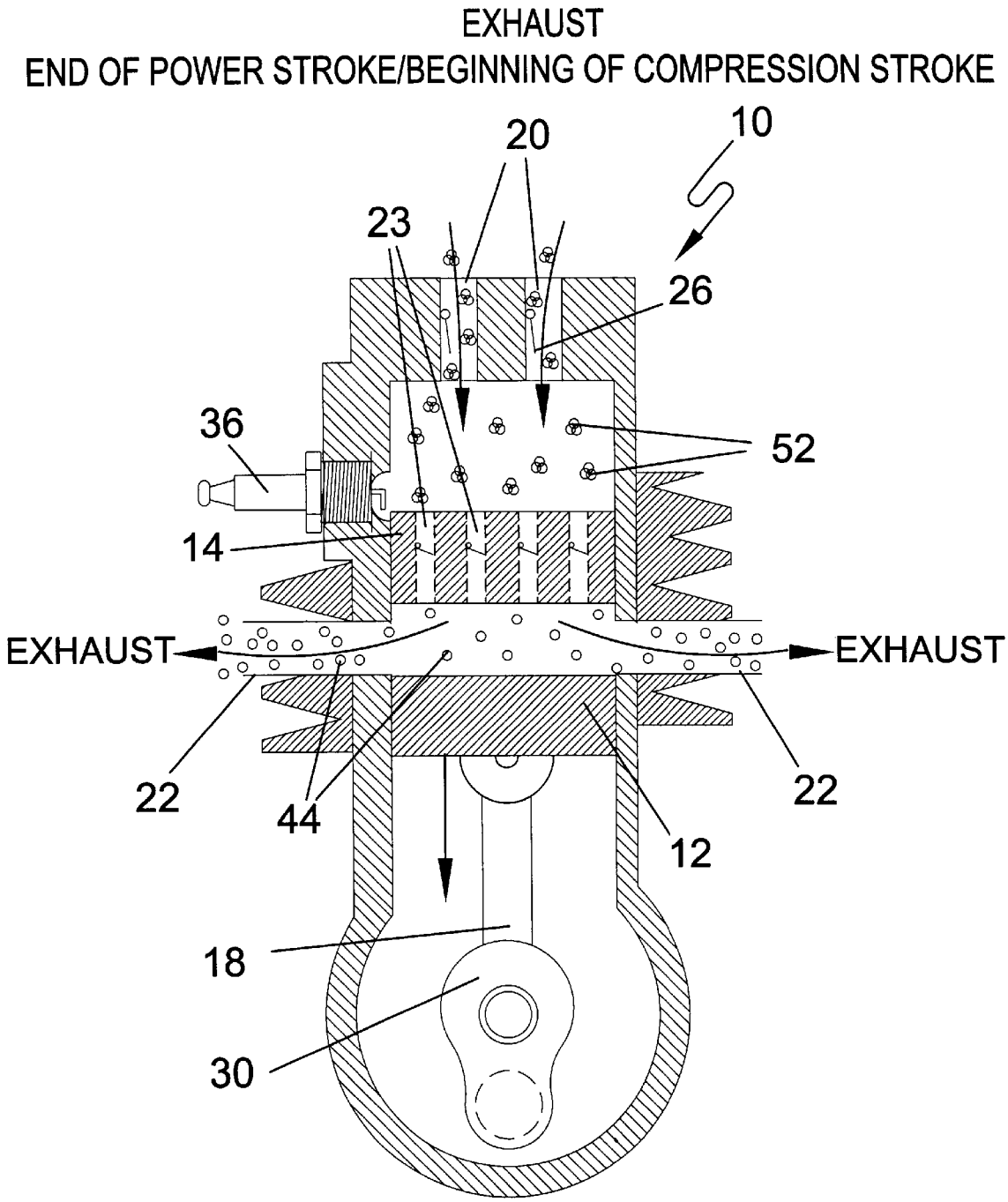
FIG. 7 is a diagram of the present invention during exhaust.
Figure 8:
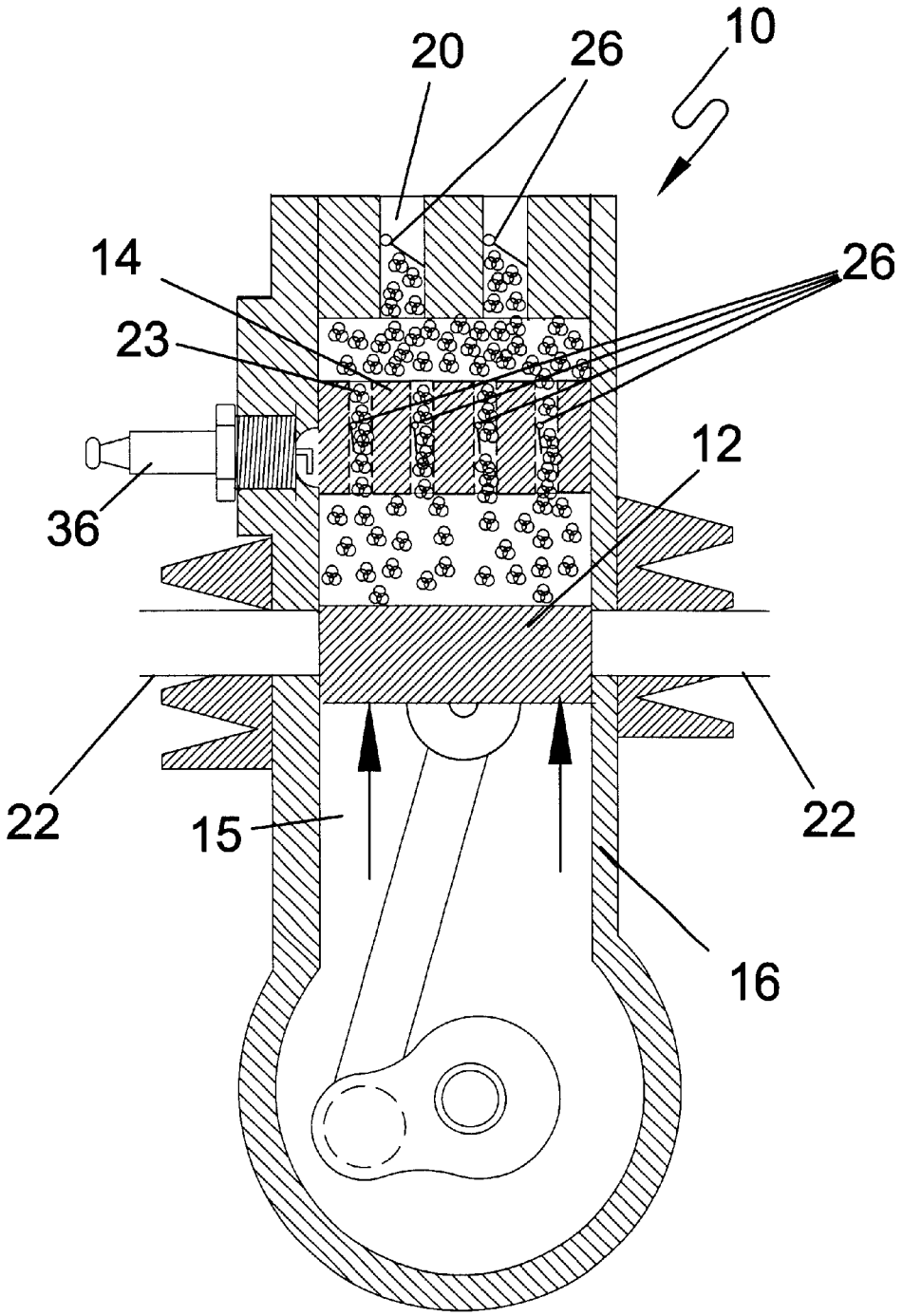
FIG. 8 is a diagram of the present invention during the compression stroke.
Figure 9:
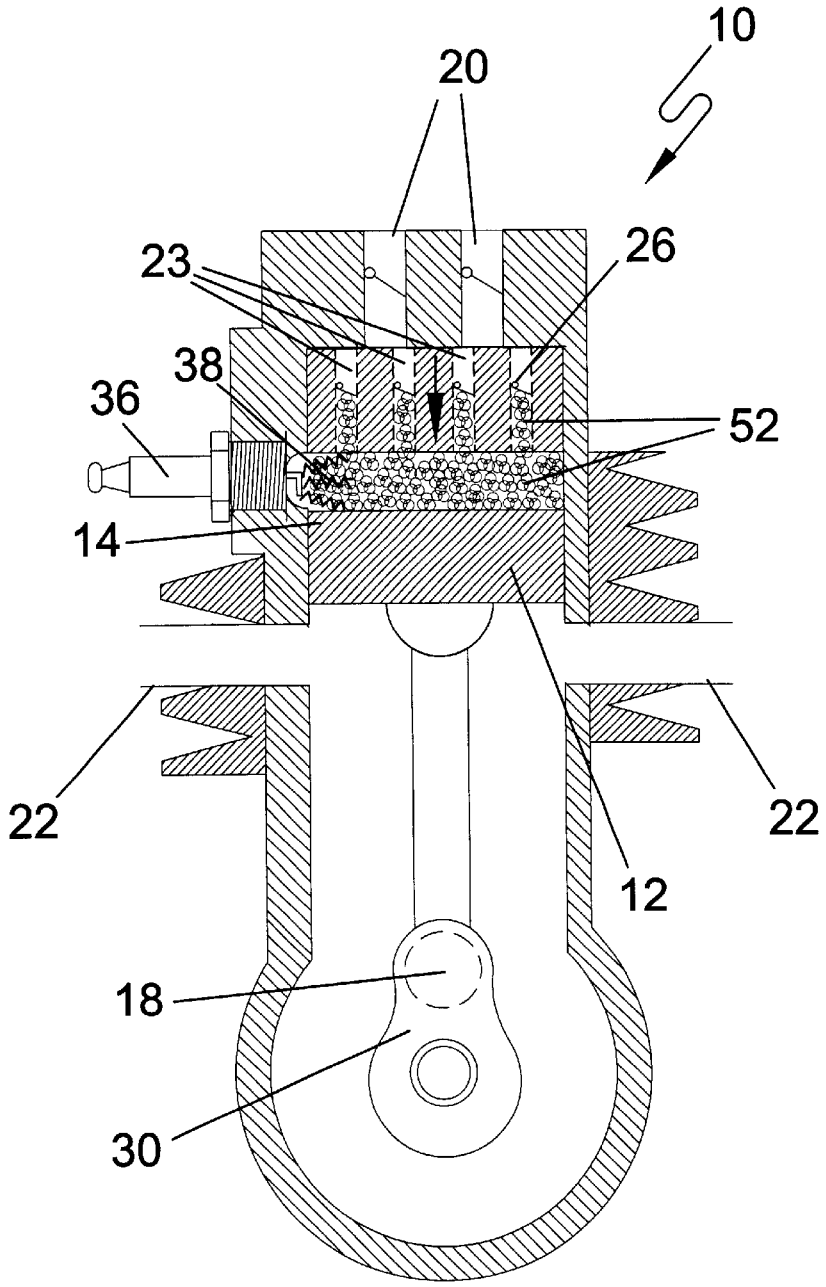
FIG. 9 is a diagram of the present invention at the end of the compression stroke.
Figure 10:
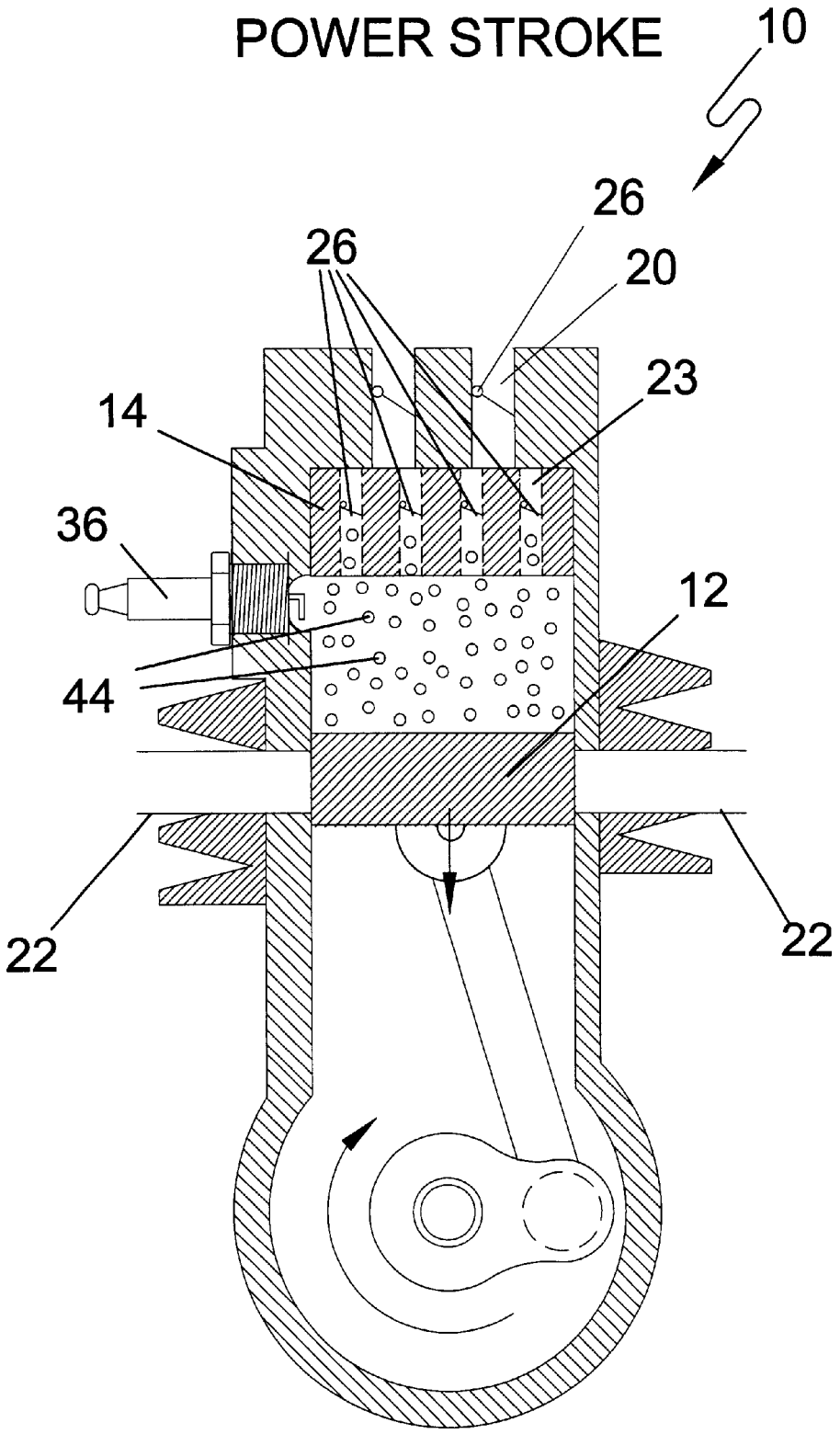
FIG. 10 is a diagram of the present invention during the power stroke.

FIGS. 7, 8, 9 and 10 are cross sectional side views of the present invention 10 as adapted for application to a two-cycle spark ignition engine with FIGS. 7, 8 and 9 demonstrating stages of the compression stroke. FIG. 7 shows the end of the power stroke/beginning of the compression stroke. At the beginning of the compression stroke the primary piston 12 has fully descended and the exhaust ports 22 are uncovered thus allowing the descending intake/exhaust piston 14 to expel the burned gases 29; simultaneously, an air/fuel mix 52 is entering the cylinder 15 above the intake/exhaust piston 14 through the intake ports 20. One-way check valves 26 in the intake ports 20 permit the air/fuel mix 52 to travel into the cylinder 15 while prohibiting it from exiting therethrough. Piston ports 23 extending through the intake/exhaust piston 14 also include one -way check valves to allow for the directional transfer of gases therethrough from the portion of the cylinder 15 above the intake/exhaust piston 14 to the area between the primary piston 12 and the intake/exhaust piston 14 which forms the compression chamber 40 while preventing the backflow of such gases. FIG. 8 depicts the present invention 10 in the middle of the compression stroke wherein the intake/exhaust piston 14 is advancing towards the top of the cylinder 15 where an air/fuel mix 52 has been introduced through the intake ports 20 which are now sealed by the one-way valves 26 incorporated therein due to the back pressure resulting from the advancing intake/exhaust cylinder 14 thus channeling the air/fuel mix 52 though the piston ports 20 and into the compression chamber 40 where it is contained due to the following primary piston 12 which has sealed off the exhaust ports 22 and will compress the air/fuel mix 52 therein for the remainder of the stroke thereby progressively increasing the pressure and temperature of the mixture. The end of the compression stroke/beginning of the power stroke is shown in FIG. 9 wherein the intake/exhaust piston 14 has reached its zenith and channeled the air/fuel mix 52 into the compression chamber 40 where it is compressed to a volatile temperature and pressure by the advance of the primary piston 12. When near maximum compression has been achieved just before dead center a spark plug 36 introduces a spark 38 into the volatile air/fuel mix 52 in the compression chamber 40 initiating auto-ignition of the mixture and the subsequent power stroke which is illustrated in FIGS. 9, 10 and 7.

The introduction of a spark 38 into the compression chamber 40 as shown in FIG. 9 causes the combustion thereof and the expanding hot mixture acts upon the primary piston 12 and thrusts it downward as shown in FIG. 4 for the remainder of the power stroke. Referring back to FIG. 7 the intake/exhaust piston 12 soon follows and scavenges a fresh air/fuel mix 52 through the intake ports 20 and the continued descent of the primary piston 12 exposes the exhaust ports 22 through which burned gases 29 are purged by the descending intake/exhaust piston 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dual piston compression chamber for two cycle engines comprising:

a) a cylinder housing member having an annular recess forming an interior cylinder with a stationary top wall closing off a top of said interior cylinder;

b) a plurality of intake ports in said top wall of said cylinder housing member to permit the introduction of a combustible media directly into said interior cylinder;

c) at least one exhaust port in said cylinder housing member;

d) a primary piston adapted for reciprocating travel completely within said interior cylinder;

e) an intake/exhaust piston adapted for reciprocating travel completely within said interior cylinder between said primary piston and said top wall and having a plurality of passageways extending therethrough forming piston ports;

f) a one-way valve in each said piston port fully enclosed within said intake/exhaust piston for controlling the directional flow therethrough;

g) a one-way valve in each said intake port fully enclosed within said top wall for controlling the directional flow therethrough;

h) means for igniting said combustible media; and i) means for regulating the synchronization of said primary piston and said intake/exhaust piston as they travel at differing rates and distances than one another to provide the precise alignment of said pistons with the various ports during the operating cycle thereof.

2. A dual piston compression chamber for two-cycle engines as recited in claim 1, wherein said combustible means is an air charge that is compressed adiabatically to a high temperature with said intake/exhaust piston against a bottom surface of said top wall.

3. A dual piston compression chamber for two-cycle engines as recited in claim 2, wherein said ignition means is a fuel injector that sprays a finely atomized fuel into said heated air charge.

4. A dual piston compression chamber for two-cycle engines as recited in claim 1, wherein said intake/exhaust piston resides in the uppermost portion of said cylinder prior to and during ignition with said air charge trapped therebelow unable to pass through said piston ports because of said one-way valves positioned therein, the area between the ascending primary piston and momentarily stationary intake/exhaust piston defines a compression chamber wherein said trapped air charge is compressed adiabatically to a high temperature until near maximum pressure when said fuel injector sprays a finely atomized spray into said compressed air charge thereby initiating the auto-ignition and subsequent expansion thereof thus forcing said primary piston downward to begin the power stoke.

5. A dual piston compression chamber for two-cycle engines as recited in claim 4, wherein said intake/exhaust piston follows the descent of said primary piston as a fresh air charge is drawn into the region of said cylinder above said intake/exhaust piston through said intake ports.

6. A dual piston compression chamber for two-cycle engines as recited in claim 5, wherein the descent of said primary piston during the power stroke exposes the exhaust ports through which the burned gases remaining from said air charge are purged by the descending intake/exhaust piston at the end of the power stroke and the beginning of the compression stroke.

7. A dual piston compression chamber for two-cycle engines as recited in claim 6, wherein said intake/exhaust piston begins to ascend towards the top of said cylinder which is filled with said fresh air charge which is trapped therein by said one-way valves in said intake ports thereby forcing said air charge through said piston ports into said compression chamber which is sealed by the ascension of said primary piston obstructing said exhaust ports and up against a bottom surface of said top wall resulting in the compression of said air charge which is trapped therein by said one-way valves in said piston ports for the remainder of the compression stroke.

8. A dual piston compression chamber for two-cycle engines as recited in claim 1, wherein said synchronization regulation means is a crankshaft assembly.

9. A dual piston compression chamber for two-cycle engines as recited in claim 8, wherein said crankshaft assembly comprises:

a) a crankshaft;

b) a connecting rod having a first end pivotally connected to said crankshaft and a second end pivotally connected to said primary piston;

c) cam wheels axially connected to opposing ends of said crankshaft assembly;

d) an intake/exhaust piston follower track cut into said cam wheels;

e) an intake/exhaust piston follower adapted for entrainment within said intake/exhaust piston follower track during the axial rotation of said cam wheel; and f) an intake/exhaust piston follower connecting rod communicating between said intake/exhaust piston and intake/exhaust piston follower.

10. A dual piston compression chamber for two-cycle engines as recited in claim 1, wherein said combustible means is a fuel/air mixture that is compressed adiabatically to a high temperature.

11. A dual piston compression chamber for two-cycle engines as recited in claim 10, wherein said ignition means is a spark plug that introduces a spark into said compression chamber to ignite said heated fuel/air mixture.

12. A dual piston compression chamber for two-cycle engines as recited in claim 11, wherein said intake/exhaust piston resides in the uppermost portion of said cylinder up against a bottom surface of said top wall prior to and during ignition with said fuel/air mixture trapped therebelow unable to pass through said piston ports because of said one-way valves positioned therein, the area between the ascending primary piston and momentarily stationary intake/exhaust piston defines a compression chamber wherein said trapped fuel/air mixture is compressed adiabatically to a high temperature until near maximum pressure when said spark plug ignites a spark in said compression chamber filled with said compressed fuel/air mixture thereby initiating the subsequent expansion thereof thus forcing said primary piston downward to begin the power stoke.

13. A dual piston compression chamber for two-cycle engines as recited in claim 12, wherein said intake/exhaust piston follows the descent of said primary piston as a fresh fuel/air mixture is drawn into the region of said cylinder above said intake/exhaust piston through said intake ports.

14. A dual piston compression chamber for two-cycle engines as recited in claim 13, wherein the descent of said primary piston during the power stroke exposes the exhaust ports through which the burned gases remaining from said fuel/air mixture are purged by the descending intake/exhaust piston at the end of the power stroke and the beginning of the compression stroke.

* * * * *